US005265952A

United States Patent [19]

Greshem et al.

[11] Patent Number: 5,265,952

[45] Date of Patent: Nov. 30, 1993

[54] OPERATOR WORK STATION

[75] Inventors: David Greshem; Matthew D. Hern, both of Columbus, Ohio

[73] Assignee: Fisher Controls International, Inc., Clayton, Mo.

[21] Appl. No.: 859,021

[22] Filed: Mar. 27, 1992

[51] Int. Cl.[5] ..... A47B 51/00

[52] U.S. Cl. ..... 312/312; 108/147; 108/50

[58] Field of Search ..... 312/312, 319.6, 319.8, 312/247, 223.3, 242, 201, 107, 7.2; 108/147, 50, 64; 52/36, 29, 31, 32, 65

[56] References Cited

U.S. PATENT DOCUMENTS

| | | | |
|---|---|---|---|
| 134,727 | 1/1943 | Weber . | |
| 148,058 | 12/1947 | Fletcher . | |
| 161,995 | 2/1951 | Bargen . | |
| 169,455 | 4/1953 | Revell . | |
| 210,131 | 2/1968 | Rourke . | |
| 3,635,174 | 1/1972 | Ball et al. . | |
| 3,869,992 | 3/1975 | Kramer | 108/64 |
| 3,992,067 | 11/1976 | Kane . | |
| 4,046,437 | 9/1977 | Caron et al. . | |
| 4,145,097 | 3/1979 | Naess et al. . | |
| 4,365,561 | 12/1982 | Tellier et al. . | |
| 4,657,316 | 4/1987 | Hardt et al. . | |
| 4,669,789 | 6/1987 | Pemberton . | |
| 4,815,392 | 3/1989 | Soot . | |
| 4,852,500 | 8/1989 | Ryburg et al. | 312/223.3 |
| 4,986,194 | 1/1991 | Bollman . | |
| 5,020,752 | 6/1991 | Rizzi et al. | 108/147 |
| 5,033,804 | 7/1991 | Faris . | |
| 5,101,736 | 4/1992 | Bommarito et al. | 108/147 |
| 5,103,741 | 4/1992 | Grund et al. | 108/50 |

FOREIGN PATENT DOCUMENTS

| | | | |
|---|---|---|---|
| 145410 | 6/1985 | European Pat. Off. | 312/223.3 |

*Primary Examiner*—Peter R. Brown
*Assistant Examiner*—Janet M. Long
*Attorney, Agent, or Firm*—Warren B. Kice

[57] ABSTRACT

An operator work station including a plurality of desk modules located adjacent a wall or walls and defining one or more continuous work surfaces. The modules include a standard desk module, an end, or stand-alone, module and a corner module. An opening is formed through one of the walls in a predetermined relationship with the work surface modules, and a housing for receiving a monitor is pivotally mounted for movement about a vertical axis relative to said opening to adjust the monitor relative to the work surface modules for viewing. The work surface modules can be configured to provide one or more continuous work surfaces along one wall, around a corner and along another wall.

22 Claims, 3 Drawing Sheets

OPERATOR WORK STATION

BACKGROUND OF THE INVENTION

This invention relates to a work station and more particularly to a work station which provides an operator with a comfortable work environment while providing viewing access to a video monitor or the like.

As the use of computers and computer monitors increases, it becomes increasingly necessary to provide the operators with private or semi-private work stations in which the operator is provided with a desk and a monitor used alone or in conjunction with a computer.

These types of work stations often involve modular units in order to locate as many operators as possible in a given office space to maximize space usage. However with operators spending more and more time at work stations of the above type, their comfort is compromised due to inadequate ergonomics. For example, when a computer monitor is involved in the work station, most modular work station designs position the operator in direct alignment with the monitor. However, when the operator wishes to engage in activities other than monitor viewing such as paper work, reading, etc., the space available for these activities is often inadequate.

Other problems with conventional modular work stations is that they often cannot accommodate additional personnel, are not flexible enough to adopt to different environments and do not present a finished, professional appearance. Further, these conventional work stations are not designed to cover or house the clutter caused by the wiring and cables required for the computer, the monitor and other associated electronic equipment.

SUMMARY OF THE INVENTION

It is therefore an object of the present invention to provide a work station which provides the operator a private or semi-private area which is maximized for ergonomics yet takes up a relative small amount of space.

It is a further object of the present invention to provide a work station of the above type in which adequate work surface area is provided while still permitting viewing of a computer monitor from an optimum distance.

It is a further object of the present invention to provide a work station of the above type which accommodates a plurality of operators having access to continuous work surfaces and monitors.

It is a further object of the present invention to provide a work station of the above type in which multiple operators can be provided in the area of two connecting perpendicular walls.

It is a further object to provide a work station of the above type which can be adapted to different desk and wall arrangements and yet gives a finished appearance.

Toward the fulfillment of these and other objects, the work station of the present invention includes one or more work surface modules located adjacent a wall or walls and defining one or more continuous work surfaces along the wall(s). An opening is formed through one of the walls in a predetermined relationship with the work surface modules, and a housing for receiving a monitor is pivotally mounted for movement about a vertical axis relative to said opening to adjust the monitor relative to the work surface modules for viewing.

The work surface modules can be configured to provide one or more continuous work surfaces along one wall or around a corner and along another wall.

BRIEF DESCRIPTION OF THE DRAWING

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
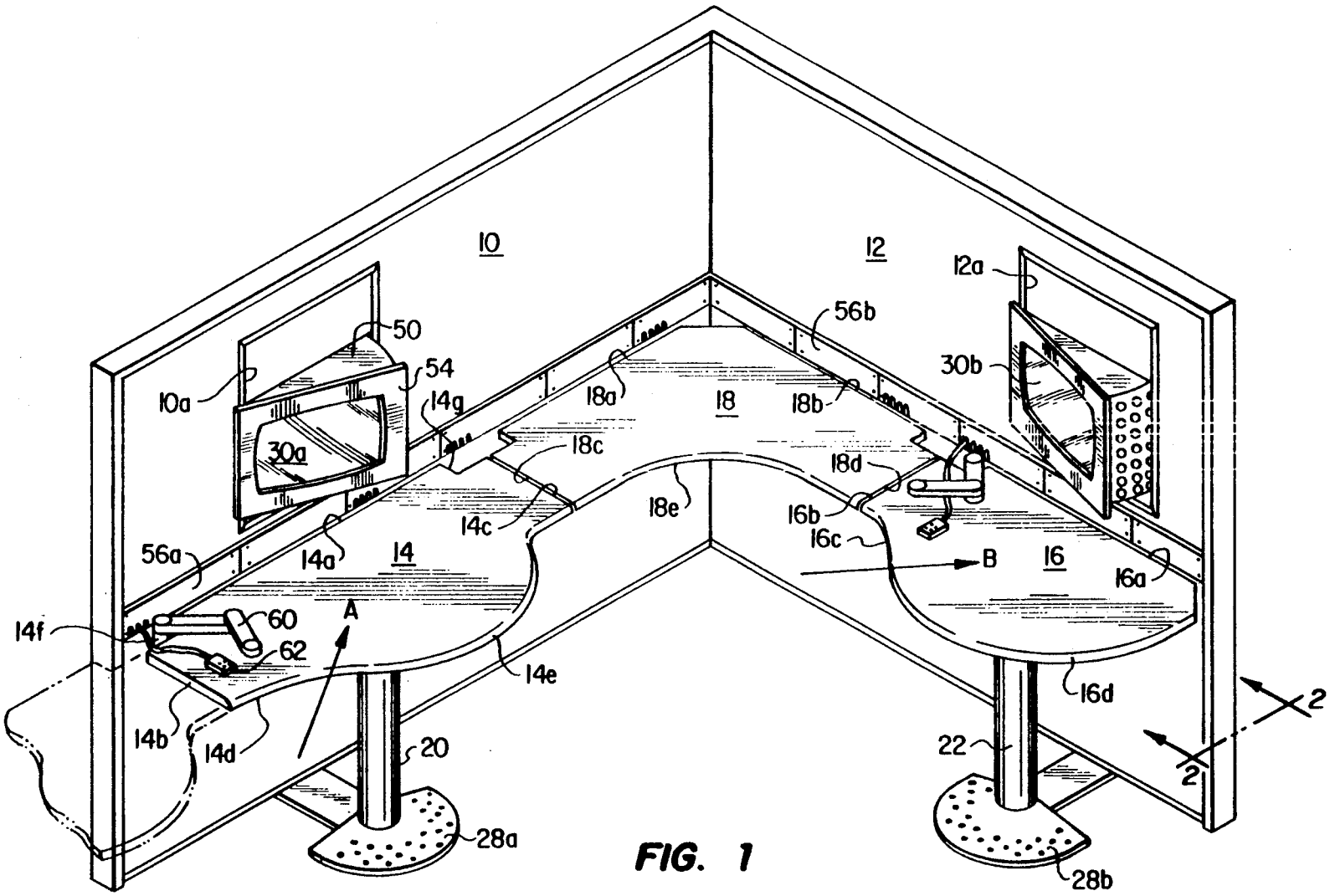
FIG. 1 is a perspective view of a work station of the present invention.

FIG. 1 of the drawing depicts an operator work station embodying features of the present invention and including two perpendicular walls 10 and 12 extending from the floor of the building to the ceiling, or to a predetermined height below the height of the ceiling. The walls 10 and 12 can be permanently installed or can be "modular", i.e. free standing and quickly assembled and disassembled. In either case the walls 10 and 12 are hollow to enable them to contain some internal components, as will be described.

For the purposes of example, the work station of FIG. 1 includes three modular desks, or work surfaces, 14, 16, and 18 with the module 14 extending adjacent the wall 10, the module 16 extending adjacent the wall 12 and the module 18 extending adjacent the corner defined by both walls. The respective ends of the corner desk module 18 are located adjacent the corresponding ends of the desk module 14 and the desk module 16, respectively.

The desk module 14 has a straight side portion 14*a* facing the wall 10 and two straight end portions 14*b* and 14*c* extending perpendicular to the side portion 14*a*. The other side of the module 14 is irregular in shape and is formed by a relatively gradually curved portion 14*d* extending from the side portion 14*b*, and a relatively abruptly curved portion 14*e* extending from the curved portions 14*d* to the other end portion 14*c*. The transition from the gradually curved portion 14*d* to the abruptly curved portion 14*e* occurs approximately midway between the end portions 14*b* and 14*c*. As a result, the desk module 14 is of minimum width near its end portions 14*b* and 14*c* and of maximum width approximately midway between its end portion 14*b* and 14*c*.

The desk module 14 is designed for a right-handed operator who would normally sit adjacent the gradually curved portion 14*d* and face in a direction indicated by the arrow A. This enables the module 14 to be dimensioned so that the operator is located an optimum viewing distance from the monitor (discussed below) yet has ample leg room and writing surface due to the increased module width resulting from the curved surfaces 14*d* and 14*e*. It is understood that a desk module similar to the module 14 can be designed for a left-handed operator in which case it would be a mirror image of the module 14, and that a plurality of desk modules 14 can be connected in an end-to-end relationship along the wall 10 as shown by the phantom lines.

The desk module 16 is a "stand-alone" module and as such, is designed to form the end module of a series of modules including the series shown in FIG. 1. The module 16 includes a straight side portion 16*a* facing the wall 12 and a straight end portion 16*b* extending perpendicularly to the side portion 16*a*. The other side of the module 16 includes a relatively gradually curved portion 16*c* extending from the side portion 16*a* and a relatively abruptly curved portion 16*d* extending from the curved portion 16*c*. The curved portion 16*d* is rounded off to also form the other end portion of the module 16 and thus gives a finished look. Therefore the module 16 is not designed to be connected between other modules but can either stand alone or form the end module of a series. The module 16 is also designed for a right-handed operator who would sit adjacent the curved portion 16*c* and normally face in a direction indicated by the arrow B. A mirror image of the module 16 could also be placed along the wall 10 and adjacent the end 14*b* of the module 14 as could also be represented by the phantom lines in FIG. 1, or, if a plurality of modules 14 are located adjacent the wall 10, at the corresponding end of the endmost module 14.

The corner module 18 includes a back portion 18*a* facing the wall 10, a back portion 18*b* extending perpendicular to the back portion 18*a* and facing the wall 12, an end portion 18*c* extending perpendicular to the back portion 18*a*, an end portion 18*d* extending perpendicular to the back portion 18*b* and a concave curved portion 18*e* extending between the end portions 18*c* and 18*d*. The end portion 18*c* of the corner module 18 is disposed adjacent the end portion 14*c* of the module 14 and the end portion 18*d* is disposed adjacent the end portion 16*b* of the module 16. It is understood that one or more modules 14 can be placed between the modules 16 and 18 to form additional stations along the wall 12.

Figure 2:
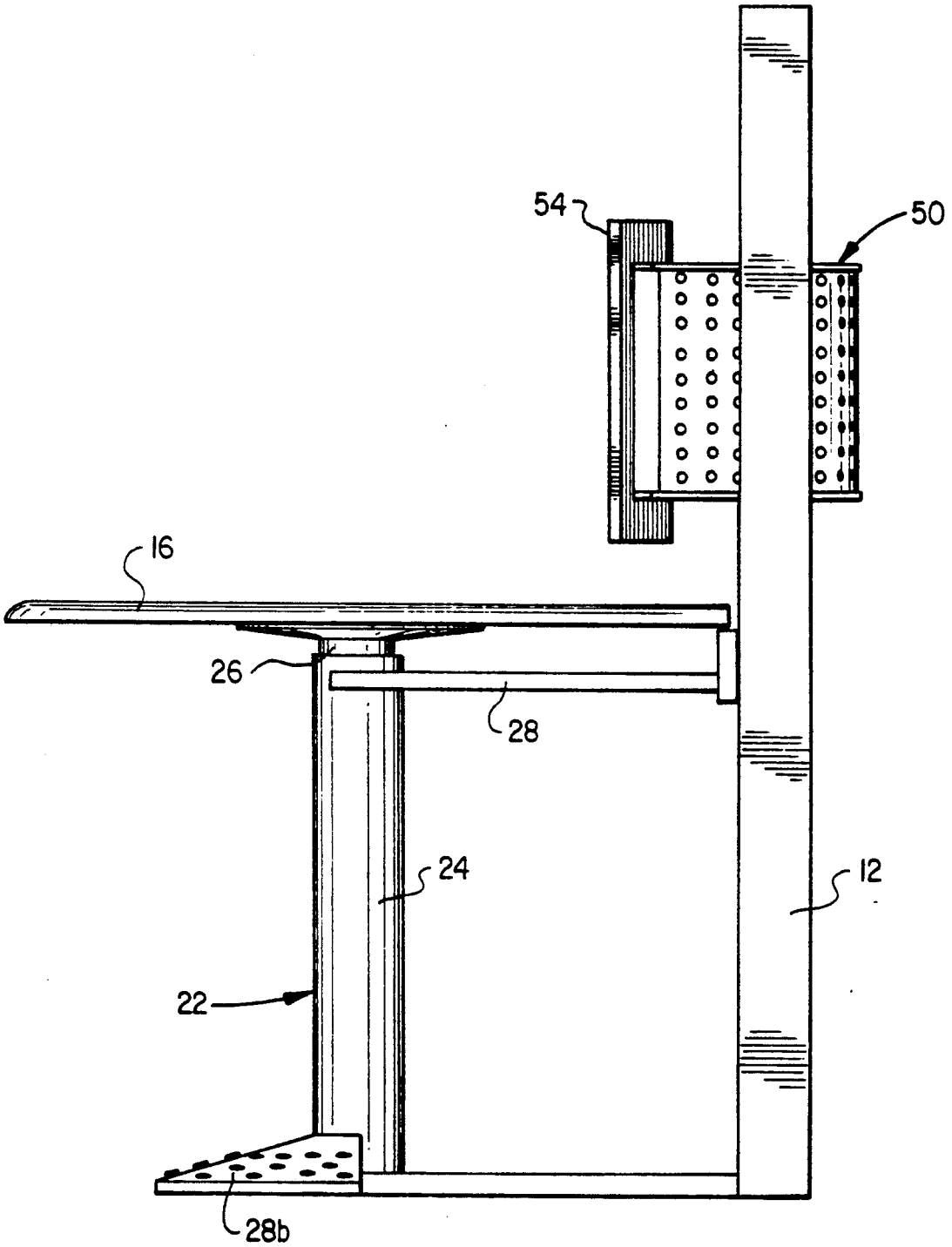
FIG. 2 is an enlarged view taken along the line 2—2 of FIG. 1.

Two pedestals 20 and 22 extend from the lower surfaces of the modules 14 and 16 respectively, and support the modules in an elevated position. The pedestal 22 is shown in detail in FIG. 2 and includes an outer cylinder 24 which contains an electric motor (not shown) and a piston 26 telescopingly mounted within the cylinder for reciprocal movement in an axial direction in a conventional manner. The upper end of the piston 26 abutts against (and can be fastened to) the central portion of the lower surface of the desk module 16. A U-shaped bracket 28 (partially shown) extends around the upper end portion of the cylinder 24 and is fastened, in any conventional manner to the wall 12. Thus, actuation of the motor can raise or lower the desk module 16. Since the pedestal 20 is identical to the pedestal 22 it will not be described in detail.

The pedestals 20 and 22 extend through bases 28*a* and 28*b* which rest on the floor, provide support for the pedestals and cover the electrical wire and cables (not shown) extending from the pedestals.

It is understood that the corner module 18 is supported by brackets, or the like (not shown) affixed to the walls 10 and 12. Alternatively, the module 18 could be supported by a pedestal identical to the pedestals 20 and 22.

Figure 3:
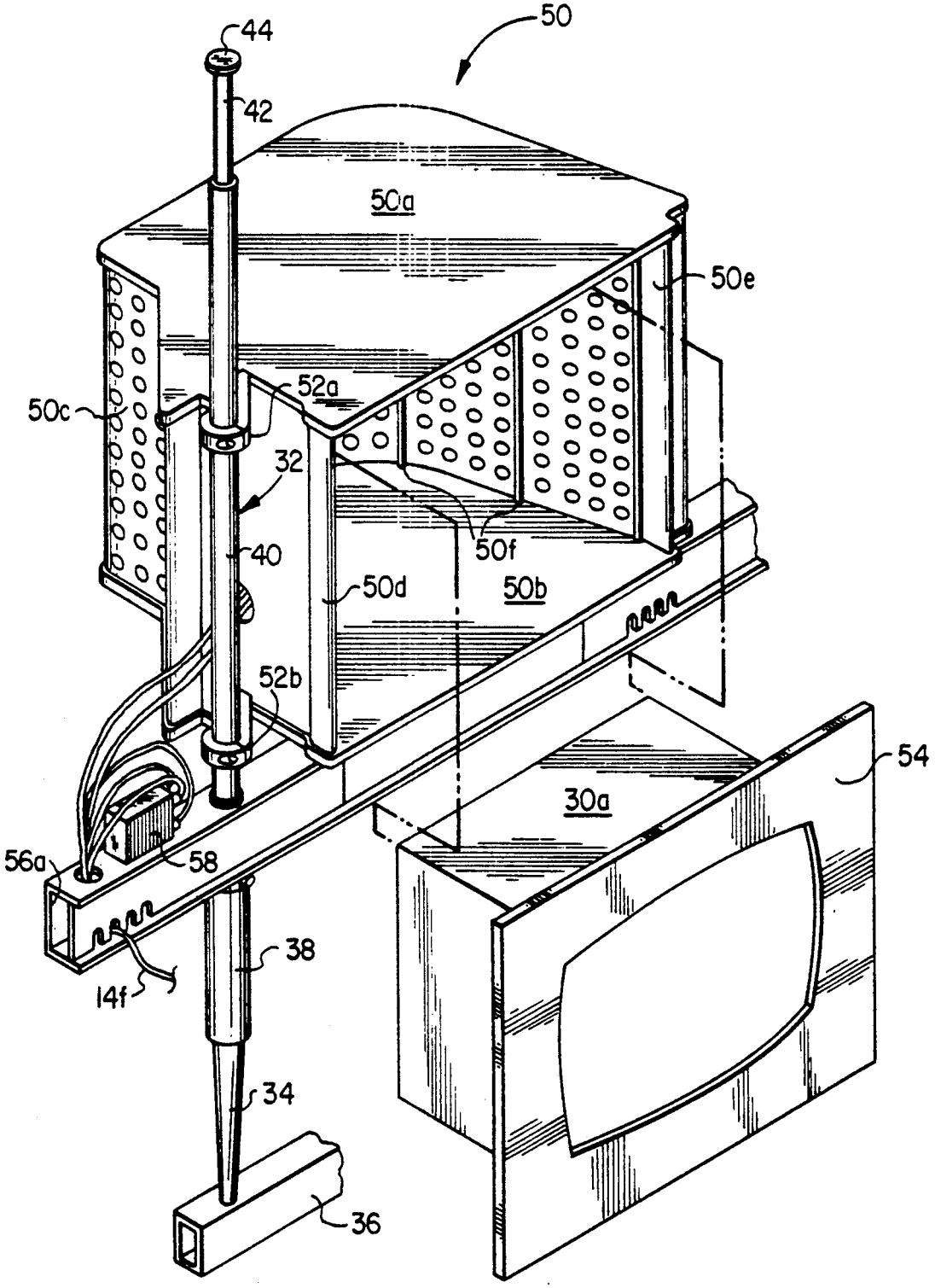
FIG. 3 is an enlarged, partial broken-away view of a portion of the work station of FIG. 1.

As shown in FIG. 1, two rectangular openings 10*a* and 12*a* are provided in the walls 10 and 12, respectively, and receive video monitors 30*a* and 30*b*, respectively. The monitors 30*a* and 30*b* are mounted for pivotal and reciprocal movement relative to the openings 10*a* and 10*b* as better shown in FIG. 3 in connection with the monitor 30*a*. More particularly, a vertical support assembly 32 is mounted within the hollow wall 10 which is not shown in FIG. 3 for the convenience of presentation. The support assembly 32 includes a lower rod 34 resting on a lower frame 36 of the wall, and a cylindrical electrical motor 38 mounted over the rod 34 and fastened thereto in any conventional manner. An outer cylinder 40 extends above the motor 38 and receives a telescoping inner rod 42, the upper end of which engages a cap 44 in engagement with the ceiling of the building.

The motor 38 includes an outer cylindrical housing which receives a piston, or drive member (not shown), which, upon actuation of the motor, reciprocates axially relative to the outer cylindrical housing. Since this type of motor is well documented in the prior art and well known to a person of ordinary skill in this art, it will not be described in any further detail. The piston is attached to the lower end of the cylinder 40 to transmit the reciprocal movement to the latter cylinder. Since the upper end of the inner rod 42 is fixed relative to the ceiling and since the lower end portion of the rod telescopes within the cylinder 40, actuation of the motor 38 causes reciprocal movement of the cylinder 40 relative to the cylinder housing of the motor 38 and relative to the fixed rod 42.

A cage, or housing 50 is provided which receives the monitor 30*a* and consists of an upper plate 50*a*, a lower plate 50*b* and a contoured, back wall 50*c* a portion of which is perforated. Additional support structure, including two end struts 50*d* and 50*e* and a plurality of spaced rods 50*f* extending between the plates 50*a* and 50*b*, support the plates 50*a* and 50*b* and the wall 50*c* in the above manner.

The housing 50 is mounted to the cylinder 40 by collar brackets 52*a* and 52*b* which extend around the cylinder 40 and are connected, in any conventional manner, to the upper and lower plates 50*a* and 50*b*, respectively, of the housing 50. The brackets 52*a* and 52*b* are secured around the cylinder 40 so that they rotate with the cylinder 40 relative to the rod 42, thus enabling the housing 50, and therefore the monitor 30*a*, to be pivoted about the vertical axis of the support assembly 32. As a result, the angular disposition of the monitor 30*a* can be adjusted relative to the wall 10, with the contoured back wall 50*c* permitting this movement over a fairly large angle. Also, actuation of the motor 38 raises or lowers the cylinder 40 and therefore the housing 50 to enable the height of the monitor 30*a* to be adjusted.

A bezel, or trim fitting 54 (FIG. 1) extends from each edge of the monitor 30*a* to cover the gap between the monitor and the wall surfaces defining the opening 10*a*. It is noted that the bezel 54 also provides a convenient structure to be gripped by the operator to pivot the housing 50, and therefore the monitor 30*a*, about the support assembly 32 as described above.

Since a housing identical to the housing 50 supports the monitor 30*b* in the opening 12*a* in an identical manner, it will not be described.

Horizontal raceways 56*a* and 56*b* are mounted in the walls 10 and 12, respectively, at the approximate level of the desk modules 14, 16 and 18 and define compartments for receiving electrical wires, cables, etc., extending from the electrical motor in the pedestal 20, the motor 38, and the monitor 30*a*. The raceways 56*a* and 56*b* have front plates to cover the wires and cables which plates are provided with openings to permit the wires and cables to be inserted into and extend from the raceways. Although not shown in the drawings it is understood that a vertical raceway could be provided in the walls 10 and 12 as needed. A junction box 58 (FIG. 3) is mounted on the raceway 562 for facilitating the various electrical connections in a conventional manner. In this context various cutouts can be provided through desk modules 14, 16, 18 for stringing wires and cables, with examples being shown by the references 14*f* and 14*g* in FIG. 1.

Auxiliary equipment may be mounted on the desk modules 14, 16 and 18. For example a pivoted bracket assembly 60 is mounted, in any conventional manner, to the desk module 14 for supporting an auxiliary monitor, display or the like.

A remote control device 62 is provided which rests on the desk module 14 and is electrically connected to the motor of the pedestal 20 and the motor 38 to raise and lower the desk module 14 and the monitor 30*a*, respectively.

In use, the operator sits at the desk module 14 in a chair, or the like (not shown) generally facing a direction indicated by the arrow A in FIG. 1. The enlarged width portion defined by the curved portions 14*d* and 14*e* provides ample legroom and presents a relatively large surface for writing, operating a keyboard, etc. or for co-workers to conference at the work station. The angular position of the monitor 30*a* can be adjusted as necessary for the viewing comfort of the operator or for group viewing and the height of the module 14 and the monitor 30*a* can be adjusted by the remote control device 62. Of course, another operator can sit at the module 16 generally facing in a direction indicated by the arrow B in FIG. 1, and the monitor 30*b* can be adjusted in the same manner as discussed above. The corner module 16 can accommodate another operator and another monitor could be provided in the corner defined by the walls 10 and 12 and mounted in the same manner as described above. Alternately, the corner module can be used as a writing surface, for storage, for auxiliary equipment or the like, as necessary.

It is understood that other office components can easily be integrated into the work station of the present invention such as detachable shelves, detachable binders, drawer storage, integrated file storage, printer cards, tables and ergonomic work station platforms.

The work station of the present invention thus has several advantages. For example, it is maximized for ergonomics yet takes up a relatively small amount of space. It provides an adequate, continuous work surface area while still permitting viewing of a computer monitor at an optimum distance. It provides one or more monitors for a plurality of operators while permitting conferencing as needed. The unique curved surfaces of the desk modules minimize space requirements yet provide for adequate work surfaces and leg room. The work station can be arranged in a multitude of configurations and is easily adaptable to different wall arrangements. It gives a finished appearance while eliminating the clutter of wires and cables. It provides for maximum comfort of the operator yet fosters team integration, communication and problem solving.

It is also understood that variations may be made in the present invention without departing from the spirit and scope of the invention. For example, any type of viewing screen other than a video monitor can be provided in the housing 50. Also four walls can be provided to define a completely enclosed area which may be sound-proofed as necessary.

Although a preferred embodiment of the present invention has been shown and described, a latitude of modification, change and substitution is intended in the foregoing disclosure, and in certain instances some features of the invention will be employed without a corresponding use of other features. Accordingly, it is appropriate that the appended claims be construed broadly and in a manner consistent with the scope of the invention.

What is claimed is:

1. A work station comprising:

wall means defining a work area and including two walls extending in a perpendicular relationship;

a plurality of work surfaces modules extending along one of said walls to form a continuous work surface;

at least one additional module extending along the other said walls;

a corner module extending between said additional module and one of the other modules;

an opening formed through at least one of said walls in a predetermined relationship with said work surface modules;

housing means for receiving a video screen; and means within said wall means for pivotally mounting said housing means for movement about a vertical axis relative to said opening to adjust the angular position of said screen relative to said work surface module means for viewing.

2. The work station of claim 1 further comprising means for raising and lowering said work surface modules to adjust its height relative to said wall.

3. The work station of claim 2 wherein said raising and lowering means comprises a pedestal extending from the floor of said work area, a piston mounted for telescoping movement within said pedestal and engaging the lower surface of said work surface module means, and means for axially moving said piston relative to said pedestal.

4. The work station of claim 1 further comprising means for adjusting the height of said housing relative to said work surface modules.

5. The work station of claim 1 wherein said at least one of said modules has an upper surface defining a work surface, one straight side portion for facing said wall means, two spaced straight end portions each extending at an angle to said straight side portion, and a curved side portion opposite said straight side portion and extending between said end portions, said curved side portion including a relatively gradual curved portion extending from one end portion, and a relatively abrupt curved portion extending from said gradual portion to said other end portion.

6. The work station of claim 1 further comprising housing means in said wall means for receiving wires and cables from said video screen and from any electronic components on said work surface module means.

7. The work station of claim 6 wherein said latter housing means comprises a raceway and a cover for said raceway, said cover having openings for said wires and cables.

8. A work station comprising:

wall means defining a work area;

work surface module means disposed adjacent said wall means and defining one or more continuous work surfaces along said wall means;

an opening formed through said wall means in a predetermined relationship with said work surface module means;

housing means for receiving a video screen the outer dimensions of which are less than the corresponding dimensions of said opening to define space between said screen and said opening;

means extending around at least a portion of said screen for covering said space when said screen is centered in said housing means; and means within said wall means for pivotally mounting said housing means for movement about a vertical axis relative to said opening to adjust the angular position of said screen relative to said work surface module means for viewing.

9. The work station of claim 8 wherein said wall means includes at least two walls extending in a perpendicular relationship.

10. The work station of claim 9 wherein said work surface module means comprises a plurality of modules extending along at least one of said walls to form a continuous work surface.

11. The work station of claim 10 wherein said work surface module means further comprises at least one additional module extending along said perpendicular wall, and a corner module extending between said additional module and one of the other modules.

12. The work station of claim 1 further comprising means for raising and lowering said work surface module means to adjust its height relative to said wall.

13. The work station of claim 12 wherein said means for raising and lowering means comprises a pedestal extending from the floor of said work area, a piston mounted for telescoping movement within said pedestal and engaging the lower surface of said work surface module means, and means for axially moving said piston relative to said pedestal.

14. The work station of claim 1 wherein said covering means defines a handle engageable by an operator to pivot said housing means about said vertical axis.

15. The work station of claim 1 further comprising means for adjusting the height of said housing means relative to said work surface module means.

16. The work station of claim 1 wherein said work surface module means comprises at least one module having an upper surface defining a work surface, one straight side portion for facing said wall means, two spaced straight end portions each extending at an angle to said straight side portion, and a curved side portion opposite said straight side portion and extending between said end portions, said curved side portion including a relatively gradual curved portion extending from one end portion, and a relatively abrupt curved portion extending from said gradual portion to said other end portion.

17. The work station of claim 16 further comprising means extending from the lower surface of said module for supporting said module in an elevated position, said supporting means extending between said end portions and between said straight side portion and said gradual curved portion.

18. The work station of claim 8 further comprising housing means in said wall means for receiving wires and cables from said video screen and from any electronics components on said work surface module means.

19. The work station of claim 18 wherein said latter housing means comprises a raceway and a cover for said raceway, said cover having openings for said wires and cables.

20. A work station comprising:

wall means defining a work area;

work surface module means disposed adjacent said wall means and defining one or more continuous work surfaces along said wall means;

an opening formed through said wall means in a predetermined relationship with said work surface module means;

housing means for receiving a video screen the outer dimensions of which are less than the dimensions of said opening;

means extending around at least a portion of said video screen for covering said opening when said video screen is centered in said opening, and means within said wall means for pivotally mounting said housing means for movement about a vertical axis relative to said opening to adjust the angular position of said screen relative to said work surface module means for viewing.

21. The work station of claim 20 wherein said covering means defines a handle engagable by an operator to pivot said housing about said vertical axis.

22. A work station comprising:

wall means defining a work area;

at least one module disposed adjacent said wall means and having an upper surface defining a work surface, one straight side portion for facing said wall means, two spaced straight end portions each extending at an angle to said straight side portion, and a curved side portion opposite said straight side portion and extending between said end portions, said curved side portion including a relatively gradual curved portion extending from one end portion, and a relatively abrupt curved portion extending from said gradual portion to said other end portion;

an opening formed through said wall means in a predetermined relationship with said modules;

housing means for receiving a video screen;

means within said wall means for pivotally mounting said housing means for movement about a vertical axis relative to said opening to adjust the angular position of said screen relative to said work surface module means for viewing; and means extending from the lower surface of said module for supporting said module in an elevated position, said supporting means extending between said end portions and between said straight side portion and said gradual curved portion.

* * * * *

UNITED STATES PATENT AND TRADEMARK OFFICE

CERTIFICATE OF CORRECTION

PATENT NO. : 5,265,952

DATED : November 30, 1993

INVENTOR(S) : David Greshem and Matthew D. Hern

It is certified that error appears in the above-identified patent and that said Letters Patent is hereby corrected as shown below:

Col. 5, line 6, "562" should be --56a--.

Signed and Sealed this

Ninth Day of August, 1994

*Attest:*

*Attesting Officer*

BRUCE LEHMAN

*Commissioner of Patents and Trademarks*